US009216419B2

(12) United States Patent
Evers et al.

(10) Patent No.: US 9,216,419 B2
(45) Date of Patent: Dec. 22, 2015

(54) PROCESSING OF WASTE INCINERATION ASHES

(71) Applicants: Friedrich-Wilhelm Evers, Helmstedt (DE); Alexandra Beckmann, Helmstedt (DE)

(72) Inventors: Friedrich-Wilhelm Evers, Helmstedt (DE); Alexandra Beckmann, Helmstedt (DE)

( * ) Notice: Subject to any disclaimer, the term of this patent is extended or adjusted under 35 U.S.C. 154(b) by 0 days.

(21) Appl. No.: 14/601,509

(22) Filed: Jan. 21, 2015

(65) Prior Publication Data

US 2015/0129466 A1 May 14, 2015

Related U.S. Application Data

(63) Continuation of application No. 14/002,382, filed as application No. PCT/EP2012/000937 on Mar. 2, 2012, now abandoned.

(30) Foreign Application Priority Data

Mar. 4, 2011 (DE) ..... 10 2011 013 030

(51) Int. Cl.

| | |
|---|---|
| ***B03B 7/00*** | (2006.01) |
| ***B03B 9/04*** | (2006.01) |
| ***F23J 1/00*** | (2006.01) |
| ***B03B 5/62*** | (2006.01) |

(52) U.S. Cl.

CPC . *B03B 9/04* (2013.01); *B03B 5/623* (2013.01); *B03B 7/00* (2013.01); *F23J 1/00* (2013.01); *F23J 2900/01001* (2013.01); *F23J 2900/01004* (2013.01); *F23J 2900/01005* (2013.01); *F23J 2900/01009* (2013.01)

(58) Field of Classification Search

CPC ..... B03B 9/04; B03B 7/00; B03B 5/62
USPC ..... 209/10, 12.1, 659
See application file for complete search history.

(56) References Cited

U.S. PATENT DOCUMENTS

| | | | | |
|---|---|---|---|---|
| 5,860,908 | A * | 1/1999 | Forrester | A62D 3/33 405/129.25 |
| 2013/0181075 | A1 * | 7/2013 | Pickens | B03B 9/04 241/14 |

FOREIGN PATENT DOCUMENTS

| | | | | |
|---|---|---|---|---|
| CH | 676116 | A5 | 12/1990 | |
| DE | 19727172 | A1 * | 2/1998 | B03B 9/04 |
| DE | 10220813 | B4 | 2/2004 | |
| DE | 102005048959 | B4 | 4/2008 | |
| EP | 0368962 | B1 | 3/1993 | |
| EP | 1 348 905 | A1 | 10/2003 | |
| EP | 1818611 | A2 | 8/2007 | |
| EP | 1818611 | A3 * | 3/2009 | F23J 1/00 |

(Continued)

*Primary Examiner* — Terrell Matthews
(74) *Attorney, Agent, or Firm* — Dinsmore & Shohl LLP

(57) ABSTRACT

The invention relates to a method for processing waste incineration ashes (A), in particular domestic waste incineration ashes (HMVA), in which the ashes are classified into a plurality of fractions of different grain size distributions in a processing plant (11) separated from the actual waste incineration process. The ashes (A) are classified exclusively using a wet classification process in the processing plant (11), only wet classification processes that are gentle to the grains being used, and the wet classification process is performed in such a way that all of the ashes (A) are classified into at least one fine fraction (I) loaded with harmful substances and at least one coarse fraction (II, III) that contains only a small amount of harmful substances or no harmful substances at all.

19 Claims, 1 Drawing Sheet

(56) References Cited

FOREIGN PATENT DOCUMENTS

| | | | | | |
|---|---|---|---|---|---|
| EP | 2052780 | A2 | | 4/2009 | |
| EP | 2062647 | A2 | | 5/2009 | |
| EP | 2128279 | A1 | | 12/2009 | |
| EP | 2062647 | A3 | * | 12/2012 | ..... B03B 9/04 |

* cited by examiner

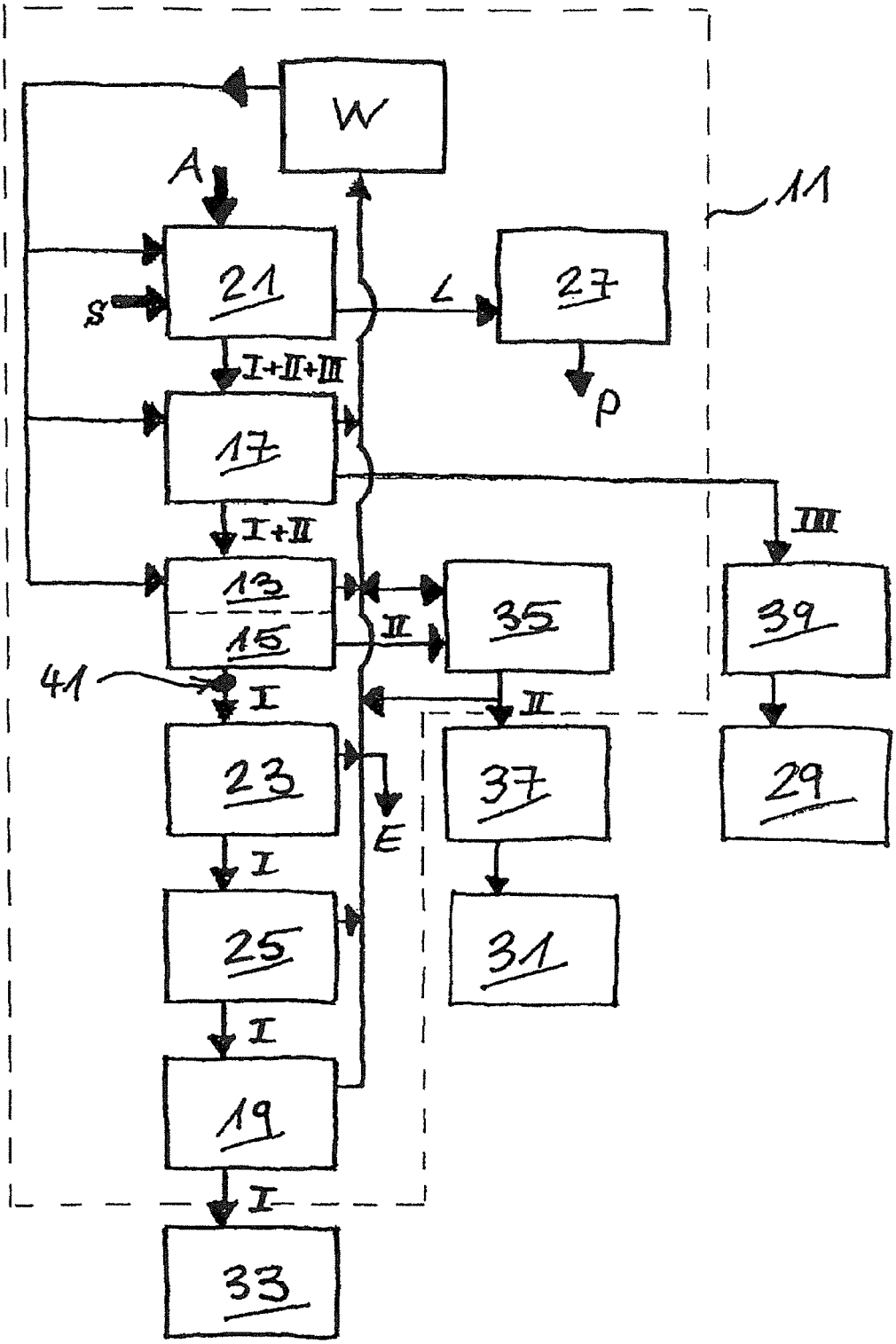
W
A
11
21
S
L
27
P
I+II+III
17
I+II
III
13
15
35
39
II
41
I
II
23
37
29
E
I
25
31
I
19
I
33

PROCESSING OF WASTE INCINERATION ASHES

CROSS-REFERENCE TO RELATED APPLICATIONS

This application is a continuation of U.S. patent application Ser. No. 14/002,382 filed Nov. 5, 2013, which is the U.S. National Phase of PCT/EP2012/000937 filed Mar. 2, 2012, which claims priority of German Patent Application 10 2011 013 030.6 filed Mar. 4, 2011.

FIELD OF THE INVENTION

The invention relates to a method and to an apparatus for processing incinerator bottom ash, in particular municipal incinerator bottom ash (MIBA), in which the ash is classified in a processing plant separate from the actual incinerator.

BACKGROUND OF THE INVENTION

A classification of ash which arises on the incineration of waste, for example industrial waste or domestic waste, is generally known. Classification is understood as a separation of a starting material comprising particles having a given grain size distribution into a plurality of fractions of different grain size distributions. The classification in particular serves to separate the ash into portions differently charged with specific contaminants, with some portions being able to be profitably recycled, while other portions have to be landfilled while incurring costs due to the existing relevant statutory regulations. A classification can utilize the generally known circumstance that specific contaminants essentially only bind ash particles having a specific maximum grain size.

Despite this knowledge, it has previously not been possible to process incinerator bottom ash in an economically interesting manner while observing statutory provisions. The incinerator bottom ash is rather usually landfilled in practice, which is, however, associated with relatively high costs, or it is utilized subject to high constraints, e.g. as a low-classification building material.

SUMMARY OF THE INVENTION

It is therefore the object of the invention to provide a possibility with which incinerator bottom ash can be supplied to recycling interesting under economic aspects.

This object is satisfied by the features of claim 1 and in particular by a method for processing incinerator bottom ash, in particular municipal incinerator bottom ash (MIBA), in which provision is made that the ash is classified into a plurality of fractions of different grain size distribution in a processing plant separate from the actual incinerator, that the classification of the ash in the processing plant takes place only by wet classification, that only classification processes are used in wet classification which are gentle on the grain, and that the wet classification is carried out such that the ash is classified completely into at least one contaminated fine fraction and at least one low-contaminant or contaminant-free coarse fraction.

The invention is based on the recognition that on a processing of incinerator bottom ash the concentration of relevant contaminants contained in the ash in a fine fraction, that is in one or more portions having a relatively low maximum grain size, can be economically interesting if it is possible to keep the portion of this fine fraction in the starting material, that is in the ash introduced into the processing, as small as possible.

The inventors have recognized that this condition can be satisfied when provision is made that it is prevented as much as possible in the processing of the ash that the particles forming the ash are comminuted since a comminution of the ash produces additional surfaces to which contaminants can bond, which has the consequence that the contaminated portion increases, and indeed in a manner such that that portion of the ash which cannot be profitably recycled, but must rather be expensively landfilled, is too large.

In this respect, the invention does not reach its goal in that the known dry classification is modified, but rather in that the incinerator bottom ash is subjected to a generally known wet classification. The inventors have recognized that the circumstance can be utilized that particularly a wet classification allows the use of classification processes which are particularly gentle on the grain. The skilled person understands classification processes gentle on the grain as such methods in which the particles to be classified are not comminuted or destroyed and in which in particular also no dust arises so that the grain size distribution of the incoming material is practically unchanged with respect to that of the outgoing material, that is of all fractions together arising in the classification.

This idea of subjecting incinerator bottom ash to a wet classification, since particularly a wet classification allows a treatment of the ash which is particularly gentle on the grain, and furthermore of configuring this wet classification such that an ash portion comprising one or more fine fractions has a grain size distribution having an upper limit such that this ash portion, on the one hand, contains all relevant contaminants, where possible, and, on the other hand, is as small as possible and makes it possible that only a relatively small portion of the ash cannot easily be recycled due to its contaminant charge, whereas a comparatively large low-contaminant or contaminant-free ash portion can be supplied to recycling.

The invention thus provides a possibility of processing incinerator bottom ash in which a significant portion of the ash can be supplied to an economically interesting recycling in accordance with even strict statutory provisions.

Preferred embodiments of the invention are also set forth in the dependent claims, in the description and in the drawing.

The wet classification is preferably carried out such that the lower limit of the grain size in the fine fraction is 0 μm and the upper limit of the grain size approximately lies in the range from 50 to 500 μm, in particular approximately lies in the range from 200 to 300 μm, and is preferably approximately 250 μm. It has been found that with such an upper limit of the grain size practically all relevant contaminants are contained in the fine fraction, with simultaneously the portion of this contaminated fine fraction in the ash introduced into the processing plant being so small that an economic processing of the ash is possible overall by the recycling of the low-contaminant or contaminant-free residue of the ash.

In a further embodiment of the invention, the wet classification comprises a classification by an upflow technique. A classification by an upflow technique is generally known. The invention can utilize this type of classification in a particularly advantageous manner since the ash is in this respect treated in a manner extremely gentle on the grain. In this respect, a hydrocyclone is preferably connected upstream of the upflow classifier.

In a further advantageous embodiment of the invention, the following steps are carried out after one another in time in the wet classification: First the ash is mixed with a liquid. At least one coarse fraction is separated from the product produced in this process. In this respect, in particular a sieve device is used. Subsequently, at least one second coarse fraction is separated from the product liberated of the first coarse fraction. In this respect, in particular an upflow technique is used. The fine fraction arising in this process subsequently has liquid removed from it. In this respect, in particular a chamber filter press can be used. A wet classification such that at least two different coarse fractions are separated in addition to the fine fraction is not compulsory, i.e. only one single coarse fraction can also be separated. It has, however, been found that such a wet classification can in particular be carried out particularly effectively with respect to the operation of the processing plant and the utilization of the low-contaminant or contaminant-free portion of the ash and is above all of advantage under economic aspects.

In a further embodiment of the invention, the ash can be subjected to a mechanical pretreatment, in particular a dry pretreatment, in which metal parts and non-incinerated impurities are removed, prior to the introduction into the processing plant. The ash can be moist in this respect. Such a preparatory processing of the ash coming from the incinerator bottom ash can—even though it can be carried out with dry or with e.g. moist ash—nevertheless take place in a manner gentle on the grain such that the grain size distribution of the ash to be introduced into the processing plant in accordance with the invention is not disadvantageously influenced. As mentioned at another passage, it is in particular of advantage with respect to a visual screening of metals for the purpose of separating the metals and thus with respect to a preferred embodiment of the invention if the separation does not take place in a dry manner, but rather the metals are previously "also washed".

In accordance with an aspect of the invention, the wet classification can be carried out such that the dry weight portion of the contaminated fine fraction in the ash which is introduced into the processing plant and from which metal parts and non-incinerated impurities were removed in a pretreatment amounts to at most approximately 30% and in particular to at most 10%. It had previously not been thought possible to process incinerator bottom ash such that only at most approximately 10 to 30% of the ash is contaminated and thus at least approximately 70 to 90% of the ash can be supplied to reclamation easily and in particular without infringing relevant statutory provisions. The wet classification of the ash in a manner gentle on the grain in accordance with the invention, however, makes just this possible.

The ash coming from the incinerator plant is preferably pretreated such that the ash is introduced into the processing plant with a grain size distribution whose upper limit amounts to no more than approximately 100 mm. The upper limit in particular lies in the range from 40 to 50 mm. The upper limit preferably amounts to approximately 44 mm. With a grain size distribution upwardly limited in this manner, but to which the invention is not restricted, the processing of the ash in accordance with the invention can be carried out in a particularly effective and, as a result, economic manner.

The processing plant preferably has a substantially closed liquid circuit. In particular water or a watery solution is used as the liquid for the wet classification.

Provision can be made in a possible embodiment of the invention that at least one parameter of a liquid used for the wet classification is held beneath or above a predefined limit value. In this respect, liquid is in particular expelled out of a liquid circuit as soon as the limit value is reached, in particular exceeded or fallen below.

This embodiment can in particular be of practical significance when, on the one hand, costs are to be saved and, on the other hand, it should be prevented that specific components are "dragged" onto the ash. Such components can in particular be salts, for example predominantly chlorides and sulfates. The concentration of these components can be determined, for example, by a conductivity measurement in the liquid, i.e. the monitored parameter in the liquid circuit can in particular be the electrical conductivity. Accordingly, liquid is only expelled out of the circuit when the conductivity has reached the predefined limit value. The consumption of fresh liquid, in particular water is hereby minimized, on the one hand, whereby costs are saved. On the other hand, it is prevented that the or each low-contaminant or contaminant-free coarse fraction contains too high a portion of the respective components, in particular of salts. The limit value can in particular be made dependent on the wishes of the respective plant operator or on the local wastewater treatment plant.

A liquid used for the wet classification in particular has a temperature in the range from 20 to 40° C.

In accordance with an aspect of the invention, a method for processing incinerator bottom ash, in particular municipal incinerator bottom ash (MIBA) is provided in which the ash is classified completely into a contaminated portion and a low-contaminant or contaminant-free portion in a processing plant separate from the actual incinerator by wet classifications.

The wet classification can in particular be carried out in accordance with the invention such that the contaminated portion in the ash which is introduced into the processing plant and from which metal parts and non-incinerated impurities were removed in an in particular dry pretreatment does not exceed a dry weight portion of approximately 30%, in particular of approximately 10%. If it is assumed that incinerator bottom ash is always at least substantially the same with respect to the grain size distribution and to the manner and the amount of the relevant contaminants at least when metal parts and non-incinerated impurities have been removed from it in an in particular dry pretreatment, the ash processing in accordance with the invention can consequently be characterized by the upper limit named here of the dry weight portion of the contaminated ash portion.

The wet classification is in particular carried out such that the lower limit of the grain size in the contaminated portion is 0 μm and the upper limit of the grain size approximately lies in the range from 50 to 500 μm, in particular approximately lies in the range from 200 to 300 μm, and is preferably approximately 250 μm.

In accordance with a further embodiment of the invention, the processing of the ash in accordance with the invention can include a metal processing, i.e. the separation of metal, at one or more points. This preparation can include both an FE separation, that is a separation of ferrous metals, and an NF separation, that is a separation of non-ferrous metals. FE separators or NF separators can consequently be used for this processing. Alternatively or additionally, a visual screening can take place. This visual screening can take place both manually and by machine. Numerous variants are generally conceivable which each allow a single-variety metal processing.

The metal processing preferably takes place at one or at each contaminant-free or low-contaminant coarse fraction before its dumping.

The separation of the metals in particular does not take place in a dry manner before or after the wet classification of the MIBA, but rather after the passing through of at least one part of the wet classification. In other words, the metals are also taken along in the wet process or washing process, i.e. the metals are also washed. This has the advantage that the metals become very clean, i.e. the metals become so pure due to the washing that they can be recognized visually with reference to their respective colors, whereby a visual screening of the metals—manually or by machine—is improved or is made possible at all. The yield of metals is also increased by this "washing along". The taking along of the metals in the wet process or washing process, i.e. the "washing along" of the metals, can also take place when no visual screening of any type takes place in the separation of the metals. The metals which are "washed along" can also be separated in a manner conventional per se using known metal separators.

In this manner, the economy of the ash processing can be substantially increased.

The object is moreover satisfied by an apparatus for processing incinerator bottom ash, in particular municipal incinerator bottom ash (MIBA), by which the ash can be classified into a plurality of fractions of different grain size distribution, wherein a processing plant is provided which is configured for an only wet classification of the ash, wherein the processing plan comprises only classification apparatus gentle on the grain, and wherein the processing plant is configured such that the ash can be completely classified into at least one contaminated fine fraction and at least one low-contaminant or contaminant-free coarse fraction.

The apparatus is in particular configured for carrying out a method of the kind set forth here.

The processing plant is preferably configured such that the lower limit of the grain size in the fine fraction is 0 μm and the upper limit of the grain size approximately lies in the range from 50 to 500 μm, in particular approximately lies in the range from 200 to 300 μm, and is preferably approximately 250 μm.

The processing plant can have at least one substantially closed liquid circuit.

The processing plant preferably comprises a mixing stage in which the ash is mixed with a liquid, in particular with water or with a watery solution.

The processing plant preferably comprises at least one classification stage, in particular a sieving device, in which at least one coarse fraction is separated from a previously produced product, in particular from the ash mixed with a liquid.

Alternatively or additionally, the processing plant can comprise at least one classification stage, in particular an upflow classifier, in which at least one fine fraction is separated from a previously produced product, in particular from a product liberated from at least one coarse fraction. The classification stage can comprise an upflow classifier having an upstream hydrocyclone.

Provision can furthermore be made that the processing plant comprises a dehumidifying stage in which liquid is removed from a previously produced product, in particular from a fine fraction.

The dehumidifying stage can comprise a chamber filter press, with in particular a round thickener and an eccentric pump being connected upstream.

In a preferred embodiment of the apparatus, a mixing stage, two classification stages and a dehumidification stage of the processing plant are arranged behind one another in the process direction, wherein in the first classification stage a coarse fraction having a lower limit for the grain size in the range of 2 to 5 mm, in particular of approximately 4 mm, is separated, wherein the remaining product is supplied to the second classification stage in which a coarse fraction having a lower limit for the grain size in the range of approximately 50 to 500 μm, in particular approximately in the range from 200 to 300 μm, and preferably of approximately 250 μm, is separated, and wherein the remaining fine fraction is supplied to the dehumidification stage.

Whereas previously in practice the MIBA was stored for a relatively long time period of e.g. three months before a processing or treatment was started, provision is preferably made in accordance with the invention that the processing or treatment of the ash is started comparatively soon after its production. This has the advantage that a bonding or sintering of the ash which has been recognized as disadvantageous does not take place or only takes place to a non-critical degree. Stored ash, in contrast, is prone to bonding or sintering, and indeed due to the chemical reactions taking place during the storage. Bonded ash must first be separated before or during the processing or treatment by "heavy equipment", i.e. with a mechanical effort which is not exactly gentle. A storage of the ash also has the consequence that contained metals can be highly charged with ash, which makes a visual screening of the metals more difficult or impossible. A disadvantageous bonding or sintering of the ash cannot occur at all or the disadvantageous chemical reactions are shortened by an early processing or treatment of the MIBA in a wet process. After this processing or treatment, a disadvantageous bonding or sintering of the ash can therefore no longer occur.

BRIEF DESCRIPTION OF THE DRAWINGS

The invention will be described in the following by way of example with reference to the drawing whose only FIGURE schematically shows an embodiment of an apparatus in accordance with the invention in which a method in accordance with the invention can be carried out.

DETAILED DESCRIPTION OF THE PREFERRED EMBODIMENTS

The apparatus in accordance with the invention comprises a processing plant 11 having various equipment which will be described in more detail in the following. The processing plant 11 is independent of the actual incinerator. The processing plant 11 can in particular be erected at any desired location and can be operated separately from an incinerator plant, with this, however, not being compulsory and generally an integration into an incinerator plant also being possible.

It is possible with the plant 11 in accordance with the invention to process the incinerator ash such as arises in the incinerator in the manner explained in the following. A pretreatment of any kind or a preparatory processing of the ash A is in particular not absolutely necessary. Nevertheless, a preferred embodiment of the invention provides that the incinerator bottom ash is subjected to a pretreatment, in particular a dry pretreatment, prior to the introduction into the processing plant 11 in which pretreatment metal parts and non-incinerated impurities are removed from the ash.

The processing method in accordance with the invention and the processing plant 11 in accordance with the invention are in particular suitable for the processing of municipal incinerator bottom ash. The invention is, however, not limited to this. It is thus also generally possible to process other incineration residues in the manner in accordance with the invention, for example ash or slag, which arises on the incineration of industrial waste.

In the embodiment of the invention explained here, the ash A introduced into a mixing stage 21 of the plant 11 and previously liberated from metal parts and non-incinerated impurities is separated into three fractions I, II and III, namely into a fine fraction I and into two coarse fractions II and III. The coarse fractions II and III are at most still slightly contaminated and can be stored on waste dumps 29, 31 before they are supplied to a use. At least the large part of the contaminants originally contained in the ash A is located in the fine fraction I which cannot be easily utilized and which is stored on a landfill 33, for example.

The contaminants usually contained in municipal incinerator bottom ash (in the following abbreviated to MIBA) are generally known. Sulfate, chloride, anhydride and TOC (total organic carbon) can be named as examples here. It must be mentioned with respect to the anhydride that it is also counted among the contaminants here with respect to a possible recycling of MIBA, for example in road construction, since its volume is substantially enlarged, i.e. swells, due to the absorption of water and can consequently develop a bursting effect, which can result in a destruction of the respective constructions.

The processing of the ash A takes place by wet classification in the plant 11 in accordance with the invention.

For this purpose, the ash A is mixed with a liquid in the mixing stage 21. Water W is preferably used as the liquid. With respect to a particularly advantageous embodiment of the processing in accordance with the invention, which will be looked at in more detail in the following, a specific watery solution, namely an acidic watery solution, is used as the liquid. For reasons of simplicity, the liquid used here will also simply be called "water" or "solution" in the following.

The mixing of the ash A with the water can take place in the sense of a steeping or mashing. Accordingly, the mixing stage 21 can also be called a steeper or masher.

The mixing of the ash A in the mixing stage 21 takes place in a manner gentle on the grain to at least largely avoid a comminution of the introduced ash particles. Where provision is made at all, a mechanical influence on the ash A in the mixing stage can take place by means of a vibration plate, for example.

A treatment of the ash A gentle on the grain does not only take place in the mixing stage 21. The total plant 11 is rather configured for ash processing gentle on the grain. As already initially mentioned, the person skilled in the art is familiar with the phrase "gentle on the grain". It is in particular understood by this that such devices or method steps in which the ash particles are comminuted are neither deliberately used nor accepted. A treatment gentle on the grain naturally does not preclude ash particles from being separated from one another which originally only stick to one another.

It must be mentioned in this connection that the skilled person is admittedly generally familiar with different wet classification methods which can be called gentle on the grain, but that the skilled person furthermore also knows such methods which can be used within the framework of a wet classification and which should deliberately induce or accept a comminution of the particles to be classified. So-called log washing can be named by way of example in this respect. The use of such methods of wet classification not gentle on the grain deliberately does not take place in accordance with the invention.

The water supplied to the mixing stage 21 is provided by a closed water circuit W. The designation as "closed" naturally does not preclude that consumed liquid can be replaced and—provided provision is made in the embodiment described here—liquid can also be removed for an additional reclamation of phosphates P explained in the following without a return into the circuit W.

To establish the mentioned acidic environment, the mixing stage 21 moreover has an acid S supplied to it which is in particular comparatively inexpensively available citric acid or sulfuric acid. The mentioned liquid circuit W is therefore in the preferred embodiment of the invention explained here a circuit of an acidic watery solution. An acidic environment is neither absolutely necessary nor disadvantageous for the wet clarification in accordance with the invention per se since all the relevant plant parts can be configured as acid-resistant without problem.

The ash A which is mixed with the water, i.e. the steeped or mashed ash, which still contains all three initially mentioned fractions I, II and II, is subsequently supplied to a first classification stage 17 which is a sieve device which is configured such that all ash particles having a grain size of more than 4 mm are separated.

In this first classification stage 17, the ash is sluiced with water W coming from the mentioned circuit and is sieved at the named 4 mm.

As regards the grain sizes of the ash particles mentioned in connection with the explanation of this embodiment, provision is made there that with an in particular dry pretreatment of the ash coming from the incinerator plant metal parts and non-incinerated impurities are removed, wherein this pretreatment takes place such that the grain size distribution of the ash A introduced into the mixing stage 21 has an upper limit of approximately 45 mm.

The first coarse fraction III separated by means of the first classification stage 17 thus has a grain size distribution of approximately 4 to 45 mm. This coarse fraction III is conducted out of the plant 11 and is stored on the already mentioned dump 29.

The remaining ash portion having a grain size distribution of approximately 0 to 4 mm, which thus includes the initially mentioned fine fraction I and the further coarse fraction II, is subsequently supplied to a second classification stage which comprises an upflow classifier 15 having an upstream hydrocyclone 13. Such arrangements are generally known so that the design and operation of this second classification stage will not be looked at in any more detail. It must be emphasized that the particles to be classified are treated extremely gently both in a hydrocyclone and in an upflow classifier. This means that the grain size distribution of the ash portion coming from the first classification stage 17 is also practically not changed by the second classification stage 13, 15.

In the embodiment explained here, the second classification stage 13, 15 is configured or set such that a second coarse fraction II is separated from the introduced product and has a grain size distribution approximately in the range from 0.25 mm to 4 mm. This coarse fraction II is supplied to a sieve device 35 which can, for example, be a so-called "E sieve" which comprises two sieve decks, wherein the material on the upper sieve deck is sluiced with water W and is dewatered on the lower sieve deck. The water W is in this respect removed from the mentioned circuit and is also supplied to this circuit again.

The further coarse fraction II dewatered in this manner is also subsequently conducted out of the plant 11 and stored on the already mentioned dump 31.

As mentioned above, the second classification stage 13, 15 is set such that the remaining fine fraction I after the separation of the second coarse fraction II has an upper limit of the grain size of approximately 0.25 mm, that is of approximately 250 μm. The configuration of the plant 11 and in particular of the second classification state 13, 15 such that this upper limit for the grain size of the fine fraction I is exactly observed is not compulsory. The upper limit for the grain size of the fine fraction I is in particular selected in dependence on the introduced ash A and in particular on the manner and amount of the contaminants contained therein and to be concentrated in the fine fraction I such that it is ensured that all relevant particles—optionally with the exception of a residue which can be tolerated with respect to applicable statutory provisions— bind to the particles forming the fine fraction I. This upper limit is in particular selected such that it is neither too low, since otherwise the next higher coarse fraction is also contaminated to a no longer tolerable degree, nor too low, since otherwise the dry weight portion of the fine fraction I in the introduced ash A is unnecessarily large.

It is achieved in this manner that all relevant contaminants of the ash A introduced into the plant 11 are located in the fine fraction I which is moreover minimized with respect to its dry weight portion in the introduced ash A. The dumped coarse fractions III and II are liberated from at least a large portion of the contaminants in this respect and can be supplied to a recycling, for example in road construction, in agreement with the respectively applicable statutory regulations.

Liquid is subsequently removed from the fine fraction I coming from the second classification stage 13, 15 in a round thickener 23.

Subsequently, the fine fraction I is supplied to a chamber filter press 19 by means of an eccentric pump 25. Instead of a chamber filter press, a cyclone can also be provided, for example, to further dewater the fine fraction I. The use of a chamber filter press has, however, been found to be particularly advantageous to date.

The fine fraction I conducted from this dehumidification stage formed by the round thickener 23, the eccentric pump 25 and the chamber press 19 is dehumidified so much that it is semisolid and can thus be landfilled. The water W arising in this dehumidification stage is again supplied to the circuit.

Trials have shown that the manner of wet classification of MIBA described here having an upper limit of the original grain size distribution of approximately 45 mm produces a fine fraction I having grain sizes of up to 0.25 mm, wherein the fine fraction I, on the one hand, contains all the relevant contaminants and, on the other hand, only represents approximately 10% of the dry weight of the ash A introduced into the plant II. This means that a dry weight portion of approximately 90% of the ash A introduced into the plant 11 can be utilized without problem with the two produced coarse fractions III and II since these coarse fractions III and II are low in contaminants or free of contaminants.

The practical realization of the invention is already economically interesting to a high degree due to this utilization possibility for incinerator bottom ash which had previously not been considered realizable despite the costs for the construction and the operation of the processing plant 11 in accordance with the invention. In addition, there is the fact that the operators of incinerator plants have an interest in not themselves having to provide a disposal of the incinerator bottom ash according to regulations since to date this disposal has taken place by landfilling or by utilization subject to high constraints of the total ash arising in the incinerator, which is associated with high costs due to the contaminants contained and due to the statutory provisions in this respect. Consequently the operators of incinerator plants are willing to pay for the taking away of the incinerator bottom ash in order not to have to take over the complicated handling themselves. The economy of the ash processing in accordance with the invention is thereby further increased since the acceptance of the ash to be introduced into the processing plant can already be associated with income. Provided that the mentioned pretreatment of the ash coming from the incinerator plant is carried out at all for removing metal parts and/or non-incinerated impurities, this pretreatment does not stand in the way of the economy of the procedure in accordance with the invention.

In the embodiment of the invention described here, the economy of the ash processing is furthermore further increased in that materials are recycled from the ash A introduced into the plant which can in turn be supplied for utilization. This utilization of the ash, in particular the reclaiming of phosphates explained in the following, represents an independent, separately claimable aspect of the invention independently of the wet classification of the ash A.

As mentioned, this further utilization of the incinerator bottom ash in the embodiment described here relates to the reclamation of phosphates P. In this respect, the circumstance is exploited that the ash A anyway interacts with a liquid in the above-described wet classification. In particular the closed liquid circuit W has the consequence that the liquid can interact a relatively long time and intensely with the ash A, which is utilized in accordance with the invention.

A resolution of phosphates P contained in the introduced ash A can thus take place by a suitable choice of the liquid, wherein these phosphates P can be isolated again in a further method step.

As already mentioned above, in the preferred embodiment, water W is used as the liquid for the wet classification which is enriched in the mixing stage 21 with acid S, in particular with citric acid or sulfuric acid. The mixing or steeping or mashing of the ash A with the liquid which takes place in the wet classification thus simultaneously represents a treatment of the ash A with an acidic watery solution which has the consequence of a resolution of the phosphates P contained in the ash A.

Within the framework of the wet classification of the ash A described here, for which an acidic environment is not compulsory, but is also not disadvantageous since all relevant plant parts are configured as acid-resistant, this kind of reclamation of phosphates P is particularly advantageous since the mixing of the ashes A with the water A or with the acidic watery solution and in particular the closed liquid circuit allows an intimate reaction of the ash A with the acidic water solution which lasts a particularly long time. This combination—expressed in keywords, that is the wet classification of incinerator bottom ash with an integrated reclamation of utilizable materials, in particular phosphates—generally likewise represents an independent, autonomous and separately claimable aspect of the invention.

The resolution of the phosphates P is promoted by a higher temperature of the acidic watery solution without hereby impairing the wet classification. While taking account of the energy input required for the heating of the liquid and the associated costs, the temperature is selected such that the plant can be operated in an economic optimal range overall. It has been found that this is already possible at a temperature of the acidic watery solution in the closed circuit in the range from 20 to 40° C.

The removal of liquid, including the phosphates P resolved therein, also called a solution L in the following, can take place without problem during the ongoing wet classification operation.

An ongoing removal of the solution L is generally possible. Provision can alternatively be made that a specific quantity of the solution L is only removed from the circuit W at specific points in time. These points in time can in particular be selected in dependence on the pH of the circulating liquid.

The removal of the solution L containing the resolved phosphates P can generally take place at any desired point of the liquid circuit W. A removal device can be provided for this purpose which can be controlled or regulated in dependence on the pH of the solution L.

The solution L is supplied to an isolating device 27 in which a reprecipitation of the phosphates P takes place in a generally known manner. The liquid remaining after the isolation of the phosphates P is again supplied to the circuit W.

In this manner, a valuable resource which can in turn be supplied to a profitable utilization is produced with the phosphates P which are isolated from the solution L taken from the circuit W.

Since the reprecipitation of phosphates from a solution, including methods and devices to be used in this process, is generally known per se, it will not be looked it in more detail at this point.

It is generally also possible in accordance with the invention to recycle other materials from the incinerator bottom ash alternatively or additionally to phosphates in that the wet classification is utilized and thus the circumstance that a resolution of materials contained in the ash takes place due to the intense contact of the ash with a liquid, which anyway takes place, wherein as required the liquid used in the wet classification is enriched in a suitable manner. This recycling of usable materials from incinerator bottom ash treated with a suitable liquid also represents an independent separately claimable aspect of the invention independently of a wet classification of the ash.

In the embodiment shown in the FIGURE, a measuring device in the form of a potentiometric probe 41 is connected before the round thickener 23 and the electrical conductivity of the liquid can be measured with it. If the conductivity reaches a predefined value, which can be predefined, for example, by the local operator of the processing plant or of the wastewater treatment plant, a predefined quantity of liquid can be expelled and can be replaced with fresh liquid, in particular with fresh water. The water expulsion E can—as shown by way of example in the FIGURE—take place after the round thickener 23 viewed in the process direction.

Provision is furthermore made in the embodiment shown here that a respective metal processing 37, 39 takes place before the dumping of the two coarse fractions II, III. This can take place in a varied manner in dependence on the circumstances and on the demands, as has already been mentioned by way of example in the introduction. The metal processing preferably takes place such that the metals are taken along, i.e. "washed along" in the wet process or washing process before their separation so that a visual screening is improved or made possible at all since the metals become particularly clean by this taking along of the metals in the wet process.

The invention claimed is:

1. A method for processing incinerator bottom ash (A) in which the ash (A) is classified into a plurality of fractions (I, II, III) of different grain size distribution in a processing plant (11) separate from the actual incinerator, the classification of the ash (A) in the processing plant (11) taking place only by a wet classification;

wherein only wet classification processes gentle on the grain are used in the classification;

wherein the wet classification is carried out such that the ash (A) is classified completely into at least one contaminated fine fraction (I) and at least one low-contaminant or contaminant-free coarse fraction (II, III); and the ash coming from the incinerator plant is pretreated such that the ash (A) is introduced into the processing plant (11) with a grain size distribution whose upper limit does not amount to more than approximately 100 mm.

2. The method in accordance with claim 1, wherein the wet classification is carried out such that the lower limit of the grain size in the fine fraction (I) is 0 μm and the upper limit of the grain size approximately lies in the range from 50 to 500 μm.

3. The method in accordance with claim 1, wherein the wet classification comprises a classification by an upflow technique.

4. The method in accordance with claim 1, the method comprising the following steps which are carried out after one another in time during the wet classification:

the ash (A) is mixed with a liquid (W);

at least one first coarse fraction (III) is separated from the product produced in this process;

at least one second coarse fraction (II) is separated from the product liberated of the first coarse fraction (III); and liquid (W) is removed from the fine fraction (I) produced in this process.

5. The method in accordance with claim 1, wherein the ash (A) is subjected to a mechanical pretreatment in which metal parts and non-incinerated impurities are removed from the ash (A) prior to the introduction into the treatment plant (11).

6. The method in accordance with claim 1, wherein the wet classification is carried out such that the dry weight portion of the contaminated fine fraction (I) in the ash (A) which is introduced into the processing plant (11) and from which metal parts and non-incinerated impurities were removed in a pretreatment amounts to at most approximately 30%.

7. The method in accordance with claim 1, wherein the processing plant (11) has a substantially closed liquid circuit.

8. The method in accordance with claim 1, wherein a liquid (W) used for the wet classification has a temperature in the range from 20 to 40° C.

9. The method in accordance with claim 1, wherein at least one parameter of a liquid used for the wet classification is held beneath or above a predefined limit value.

10. An apparatus for processing incinerator bottom ash (A) by means of which the ash (A) can be classified into a plurality of fractions (I, II, III) of different grain size distribution, the apparatus comprising a processing plant (11) which is configured for an only wet classification of the ash (A);

wherein the processing plant (11) only comprises classification devices gentle on the grain;

wherein the processing plant (11) is configured such that the ash (A) can be completely classified into at least one contaminated fine fraction (I) and at least one low-contaminant or contaminant-free coarse fraction (II, III); and wherein the processing plant (11) comprises a dehumidification stage (23, 25, 19) in which liquid (W) is removed from a previously produced product.

11. The apparatus in accordance with claim 10, wherein the processing plant (11) is configured such that the lower limit of the grain size in the fine fraction (I) is 0 μm and the upper limit of the grain size approximately lies in the range from 50 to 500 μm.

12. The apparatus in accordance with claim 10, wherein the processing plant (11) has at least one substantially closed liquid circuit.

13. The apparatus in accordance with claim 10, wherein the processing plant (11) comprises a mixing stage (21) in which the ash (A) is mixed with a liquid (W).

14. The apparatus in accordance with claim 10, wherein the processing plant (11) comprises a classification stage (17), in which at least one coarse fraction (III) is separated from a previously produced product.

15. The apparatus in accordance with claim 10, wherein the processing plant (I) comprises a classification stage (13, 15) in which at least one fine fraction (I) is separated from a previously produced product.

16. The apparatus in accordance with claim 14, wherein the classification stage comprises an upflow classifier (15) having an upstream hydrocyclone (13).

17. The apparatus in accordance with claim 10, wherein the dehumidification stage comprises a chamber filter press (19).

18. The apparatus in accordance with claim 10, wherein a mixing stage (21), two classification stages (17, 13, 15) and a dehumidification stage (23, 25, 19) of the processing plant (11) are arranged behind one another in the process direction, wherein in the first classification stage (17) a coarse fraction (III) is separated having a lower limit for the grain size in the range from 2 to 5 mm;

wherein the remaining product is supplied to the second classification stage (13, 15) in which a coarse fraction (II) is separated having a lower limit for the grain size approximately in the range from 50 to 500 μm; and the remaining fine fraction (I) is supplied to the dehumidification stage (23, 25, 19).

19. The apparatus in accordance with claim 10, wherein the apparatus is configured to carry out a method for processing incinerator bottom ash (A).

* * * * *